US006064022A

United States Patent [19]

Jackson

[11] Patent Number: 6,064,022

[45] Date of Patent: May 16, 2000

[54] ELECTROSTATIC SEPARATION OF PARTICLES

[75] Inventor: Arnold H. Jackson, Jax, Fla.

[73] Assignee: Outokumpu Oyj, Espoo, Finland

[21] Appl. No.: 09/096,863

[22] Filed: Jun. 12, 1998

[51] Int. Cl.[7] ..... B03C 7/00

[52] U.S. Cl. ..... 209/128; 209/127.1; 209/127.4; 209/129

[58] Field of Search ..... 209/127.1, 127.4, 209/128, 129, 130

[56] References Cited

U.S. PATENT DOCUMENTS

| | | | |
|---|---|---|---|
| 2,782,923 | 2/1957 | Cook, Jr. et al. | 209/127.4 |
| 2,786,575 | 3/1957 | Roberts | 209/127.1 |
| 5,251,762 | 10/1993 | Taylor et al. | 209/127.4 |
| 5,494,171 | 2/1996 | Kazamoto et al. | 209/12.2 |
| 5,687,852 | 11/1997 | Raschka et al. | 209/127.4 |
| 5,938,041 | 8/1999 | Stencel et al. | 209/127.4 |
| 5,967,331 | 10/1999 | Katyshev et al. | 209/127.4 |

FOREIGN PATENT DOCUMENTS

| | | | |
|---|---|---|---|
| 63090 | 10/1994 | Netherlands | 209/127.1 |

*Primary Examiner*—Donald P. Walsh
*Assistant Examiner*—Daniel K Schlak
*Attorney, Agent, or Firm*—Arthur G. Yeager

[57] ABSTRACT

An apparatus and a process for subjecting a free falling stream of particles to an electrostatic field, between two rows of oppositely charged electrostatic rotating electrodes to effect a separation between particles of different electrostatic properties; the electrodes and cleaning brushes being suspended vertically and driven from their upper ends and having free lower ends. The electrode bearings are gently flushed with air from inside the electrodes and brushes to minimize the accumulation of dust thereon. The feed stream is baffled to minimize any lateral movement of the feed particles. The electrodes are fitted with commutator mechanisms to permit efficient and unchanging electrical charging of the electrodes without a separate connection from the power source to each electrode, i.e., the charging is from one to the next adjacent electrode.

20 Claims, 7 Drawing Sheets

ELECTROSTATIC SEPARATION OF PARTICLES

CROSS REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Field of the Invention

This invention relates to the technology of separating different types of particles from each other by means of the attraction and repulsion forces subjected to particles while passing through an electrostatic field. In particular, the present invention relates to improvements in this technology in maintaining a cleaner atmosphere that can function efficiently for longer periods of time, a feed system which provides free-falling feed free of outside stray velocity vector influences, and an improved commutation procedure for charging rotational electrodes.

2. Background Information

This invention relates to the technology of separating particles by means of attraction and repulsion forces applied to the particles in an electrostatic field. The prior art is well aware of the general concept of passing particles through an electrostatic field to cause the particles, having electrical charges associated therewith, to move toward or away from charged electrodes in accordance with the principles of electrostatics (like charges repel and dissimilar charges attract). Typical of the U.S. Pat. Nos. in this field of technology are 2,245,200; 2,357,658; 3,998,727; and 4,092,241. Improvements in the apparatus for such process have been directed to many features, such as the use of special transportation means to carry the particles through the electrostatic field, vibration equipment to assure random mixing of particles fed into the system, etc. Typical of such improvements is that of U.S. Pat. No. 4,849,099. Still other improvements have been needed.

The basic type mechanism of this invention is described and claimed in U.S. Pat. No. 5,251,762 issued to Joseph B. Taylor.

It is an object of this invention to provide an improved apparatus for effecting electrostatic separation of particles from a mixture of particles. Another object of this invention is to provide an electrostatic separation apparatus having continuous cleaning of the electrodes and easier to maintain. Still another object is to provide an improved charge electrification of the electrodes. A further object is to provide bearings for supporting the electrodes and brushes from the upper ends thereof and permitting the lower ends to be free. An additional object is to provide air flow from inside of the bearings to inhibit dust intrusion and bearing wear on fouling thereof. Other objects will become apparent from the more detailed description which follows.

BRIEF SUMMARY OF THE INVENTION

This invention relates to an apparatus for electrostatically separating a feed mixture of at least two types of particles which includes feeding the particles into the upper feed end and a lower discharge end between two horizontally spaced rows of a plurality of spaced rotating vertical-axis elongated cylindrical electrodes. The lower discharge end has a splitter coextensive with the discharge end, and recovering two separated products, each of different types of particles originally in the feed mixture. The rotating electrodes are continuously cleaned by a plurality of vertically positioned, rotating, elongated cylindrical brushes contacting the electrodes. Power means are supplied for rotating the electrodes and the brushes, high voltage means apply an electric charge to said electrodes.

The improvements relate to several important features:

1.) a single-end drive system wherein electrodes and electrode-cleaning brushes are suspended from their upper ends only, and driven from their upper ends, with the advantage that the build-up of dust on the supporting framework is eliminated from the lower portions thereof since there are no portions thereof and no connections between the electrodes, the brushes, and the framework, i.e., the lower ends are free and spaced above any framework;

2.) the introducer system for feeding the raw material into the separation zone between oppositely charged rows or banks of electrodes provides for a controlled flow of particles having a reduced vertical speed and a smaller opportunity for lateral diversion from the desired vertical path, with the result of producing a more uniform and clean separation of particle sizes;

3.) an air wipe system is provided to minimize the accumulation of particle dust around and in the bearings supporting the electrodes and brushes so as to provide less maintenance, less machine wear, and longer life; the system involving directing low pressure air to bearing components from within the bearing components so as to blow dust away from locations that might collect that dust and produce machinery breakdowns; and 4.) an improved high voltage transmission system for providing the necessary charging of electrodes with a minimum loss of current, the system involving the use of commutator rings, commutator strips, and commutator bearings to transmit high voltages from each rotating electrode to its neighboring rotating electrode smoothly and efficiently without arcing and without producing ionizing edges.

In general these advantages and improvements are produced in an apparatus wherein the improvement is directed to each rotating electrode having an upper end rotationally and structurally supported in a bearing in the apparatus and a freely hanging lower end spacedly above the splitter of the apparatus The single-end drive system (feature 1 above) includes a first chain drive system for the electrodes and a second chain drive system for the brushes. These drive systems are elevated sufficiently to be generally above the level of falling dust particles and employ right angle drive gears so as to minimize vertical space needs. The introducer system (feature 2 above) of this invention employs a baffled feed path protected from any unwanted lateral forces so as to provide a controlled slow speed feed rate that will allow maximum efficiency in separating the charged particles. The air wipe system (feature 3 above) provides a positive outward discharge of low pressure air to prevent dust from settling in locations which might produce mechanical shutdowns and generally and principally are centered around the bearings. The improvements in the high voltage transmission (feature 4 above) are intended to eliminate or minimize ionizing surfaces, edges, corners, etc. where arcing or grounding may occur. The commutation systems for transmitting the necessary high voltage permits the charge to pass from one electrode to the next through the bearings with efficiency.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention is an improvement over that which is described and claimed in U.S. Pat. No. 5,251,762 issued to J. B. Taylor and A. H. Jackson and assigned to Carpco, Inc., the assignee of the present invention. The novel features of the present invention are improvements over the invention of U.S. Pat. No. 5,251,762 and therefore reference back to the descriptions in that patent are used frequently herein to assist in understanding the presently described improvements.

Figure 3:
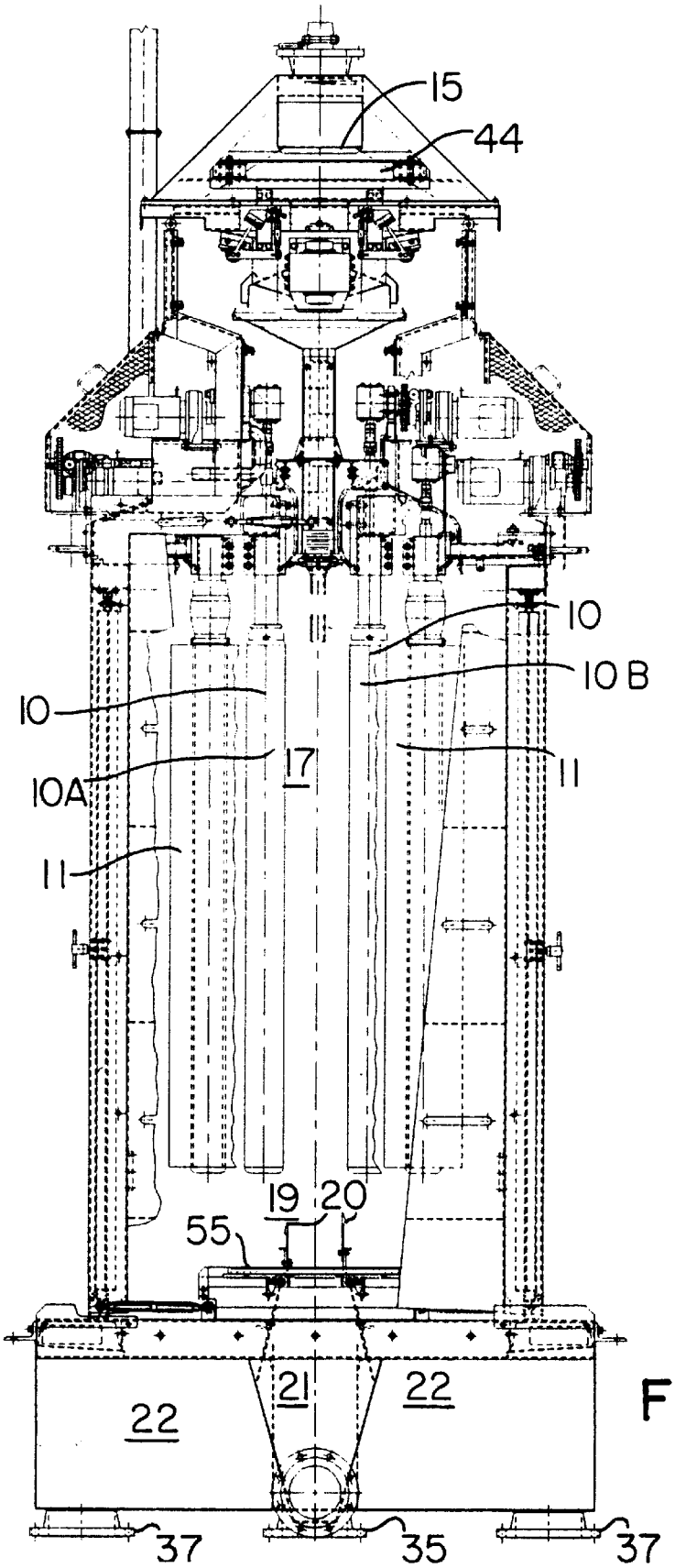
FIG. 3 is a modified showing of the end elevational view of FIG. 2 wherein the outside cover, doors and frame are eliminated so as to see the internal moving parts of the mechanism of the separator.

In the drawings of the present invention, particularly in FIG. 3, there is shown a free fall zone 17 into which is dropped from above a mixture of particles from a feed hopper 15 and at the exit 19 of which are splitters 20 to divide the product into discharge chute 21 or discharge chutes 22 for removal through ports 35 or 37, respectively.

The particles may be of any type and from any source so long as they are small enough to be dropped into zone 17 and fall freely by gravity without any substantial sidewise drifting in the fashion of an air foil. Generally, the particles should be in a size range of about 1 inch to 200 mesh (about 9.5 mm to about 0.07 mm). The particles may be natural ore, metal, limestone, calcium carbonate, silica, sodium chloride, recycled plastics, etc. The apparatus of this invention is employed to separate one type of particle from a feed mixture of two or more different types of particles, ore mixtures of metal particles, mixtures of silica particles and limestone particles, mixtures of recycled plastics, etc. Such particles normally have electrical charges associated therewith, although some particles have no such charge and are electrically neutral. The particles with charges, plus, minus or zero are separated by passing them close to electrodes that are charged plus or minus. Separation occurs because the charged particles and the charged electrodes are attracted to or repulsed from each other in accordance with the scientific fact that like charges repel each other, and unlike charges attract each other.

In the apparatus of this invention electrodes 10 are elongate cylindrical structures, solid or tubular, arranged as spaced vertical walls 10A and 10B defining the sides of free fall zone 17. The electrodes 10 in each wall 10A and 10B are positioned with their long axes vertical, parallel to each other, and spaced apart from each other. The electrodes in wall 10A are charged oppositely from the electrodes in wall 10B. A typical lateral distance between walls 10A and 10B may be about 8–24 inches with electrodes 10 being from about 3 inches to about 6 inches in diameter. The length of electrodes 10 is variable depending on free fall height required for separation of the maximum particle size in the feed stock to be separated, but generally are preferred to be from about 2 feet to about 10 feet long.

One of the key features of this invention is a system to keep electrodes 10 free from acquiring a coating of dust and other particles that might interfere with the separation efficiency of the apparatus. This system includes a plurality of elongated cylindrical brushes 11 that continuously brush away any accumulation of particles on the surface of electrodes 10. This is accomplished by continuously rotating electrodes 10 about their long axes and continuously rotating brushes 11 which are in contact with electrodes 10 on a side away from free fall zone 17. In the preferred arrangement brushes 11 and electrodes 10 are arranged into units or modules of one brush 11 for each pair of adjacent electrodes 10, the brush 11 rotating in a direction opposite to the rotational direction of the two cooperating electrodes.

Electrodes 10 and brushes 11 are rotated by any convenient drive system 9, e.g. by motors, speed reducers and drive chains; generally the rotation of brushes 11 being counter to the rotation of electrodes 10 with each brush 11 contacting two adjacent electrodes 10.

The first of the principal improvements of the present invention is the supporting connection of the electrodes 10 and the brushes 11 to the supporting framework of the separation apparatus. The sole connecting support for the vertical electrodes 10 and brushes 11 is at the upper end of those electrodes and brushes. There are internal bearings 56 at the bottom ends of the electrodes 10 for lateral support and these allow the shafts 32 to rotate the electrodes internally away from any dust. The lower end of each of the electrodes and brushes hangs free. This eliminates one dust seal and point of dust entry for each electrode and for each brush adjacent their lower ends, thereby reducing construction costs as well as maintenance and cleaning expenses. The drive system 9 for the electrodes and brushes is located above the level at which loose feed material is released for separation, and this results in less dust accumulation around the supports of the electrodes and the brushes.

Figure 1:
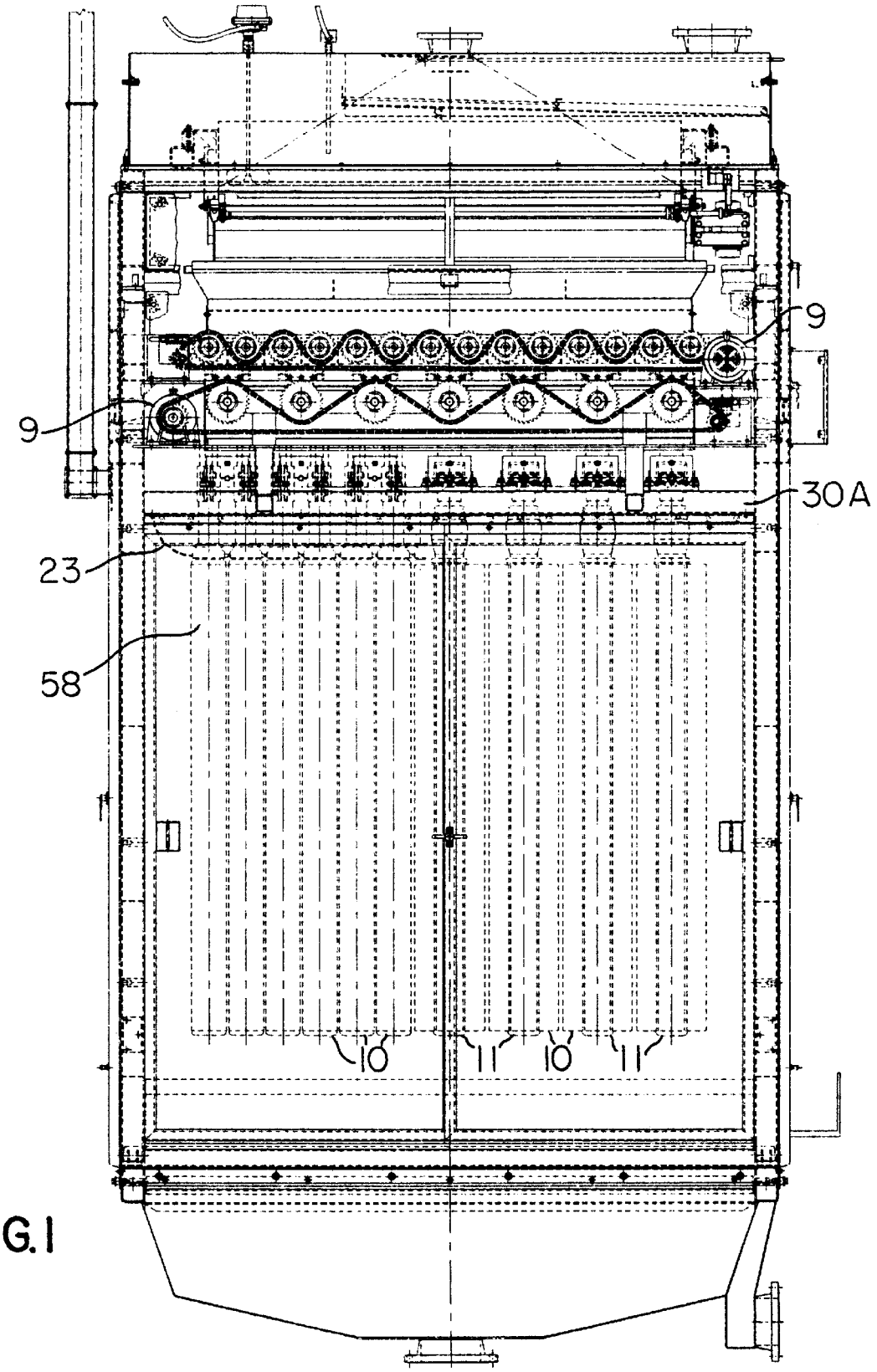
FIG. 1 is a front elevational view of the electrostatic separator of this invention.
Figure 2:
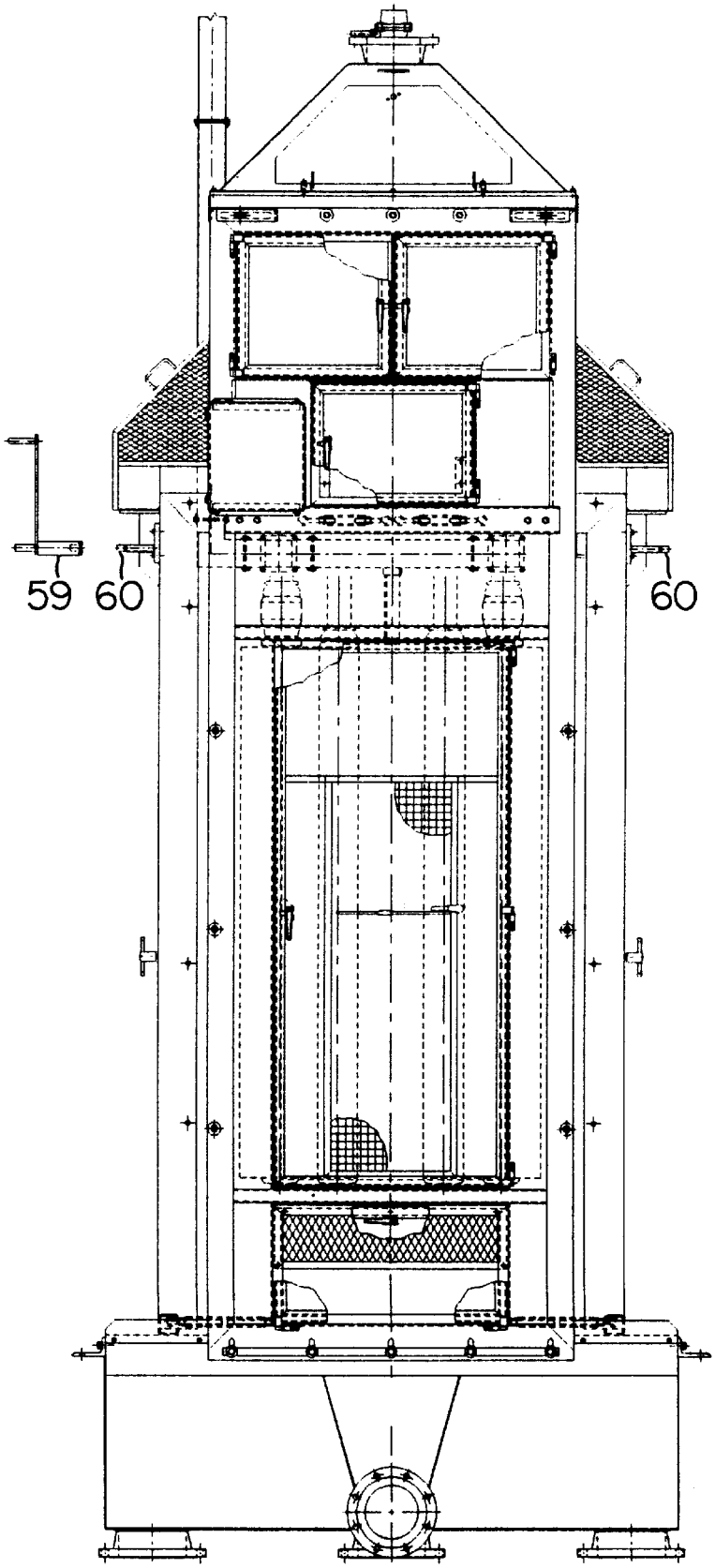
FIG. 2 is an end elevational view of the electrostatic separator of FIG. 1.
Figure 6:
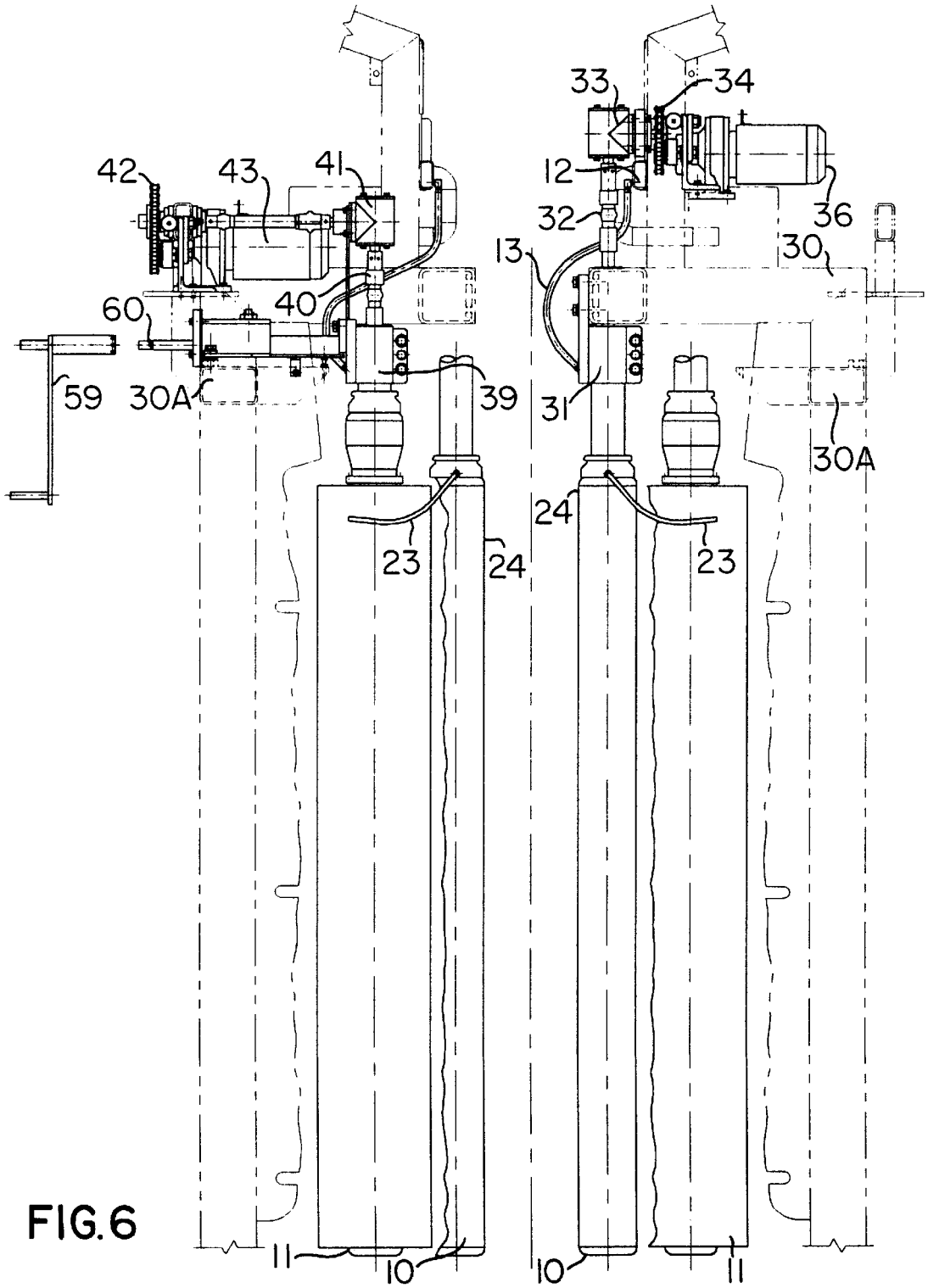
FIG. 6 shows an enlarged view of the drive system which turns the electrodes and the brushes to keep the electrodes clean.

The principal operating features of this improvement may be seen in FIG. 6, and also in portions of the assembly drawings of FIGS. 1–3. Electrodes 10 and brushes 11 hang vertically from beams 30 and 30A respectively of the supporting structure of the separator. Each electrode 10 is connected to a beam 30 by way of a beam support bracket 31 that clamps around a vertical drive shaft 38 which is connected through a right angle gear 33 to a chain drive 34 powered by a motor 35. Similarly, each brush 11 is connected to a beam 30A of the supporting structure of the separator by means of a beam support bracket 39 that clamps around a vertical drive shaft 40. Each of the brushes 11 includes a adjusting screw means 60 to permit engagement by a hand crank 59 onto screw means 60 to advance or retard the position of respective brush 11 with respect to its engagement with a pair of adjacent electrodes 10. A right angle gear 41 leads to a chain drive 42 driven by a motor 43 which drives the brushes 11. There are, of course, the necessary mechanisms for adjustment of speed, timing, and position in order to coordinate the operations of these drives.

As mentioned the second of the improvement features of this invention is the novel introducer system which is the mechanism by means of which the feed mixture is introduced into the separation zone between oppositely charged electrodes. Prior to the present invention, e.g., as shown in U.S. Pat. No. 5,251,762, the feed mixture of particles was held in a hopper until it was released onto an inclined tray which was vibrated to advance the particles to a discharge over an edge and into an adjustable space between two parallel plates that fed a sheet of particles into the electrically charged space between electrodes. The present introducer system is an improvement in that it permits a slower, more controlled method of feeding particles into the charged zone between electrodes. In the present procedure a feed supply is fed to a hopper 44 through a precisely controlled opening, with vibrational assistance, if desired; and then onto an inclined tray 46 which directs the feed particles to a space 52 between parallel vertical plates 52A having a plurality of vertically spaced baffle/shelves 52B projecting inwardly from the parallel vertical plates 52A. These baffle/shelves 52B interrupt the free fall of particles into a series of short steps alternating from one side of the vertical space 52 to the other. The particles, therefore, spill from one baffle/shelf 52B to the next throughout the length of the baffled space never permitting the particles to attain any great speed because they only fall a short distance before being reversed in direction and falling the next short step. The bottom several inches of the space is narrowed still further to make the free falling discharge even more controlled. The exact size of the final narrowing can be adjusted as desired by a gate mechanism 54 at the junction of the baffle/shelf space and the narrowed final discharge. This introducer system allows the particles not only to be confined to a smaller feed discharge opening which eliminates any horizontal velocity vector but also allows the particles leaving the final discharge space to be exactly on the centerline plane between the oppositely charged electrodes 10 as they begin to receive the charging effects of the electrodes 10, and thereby produce a better separation than otherwise produced.

Figure 4:
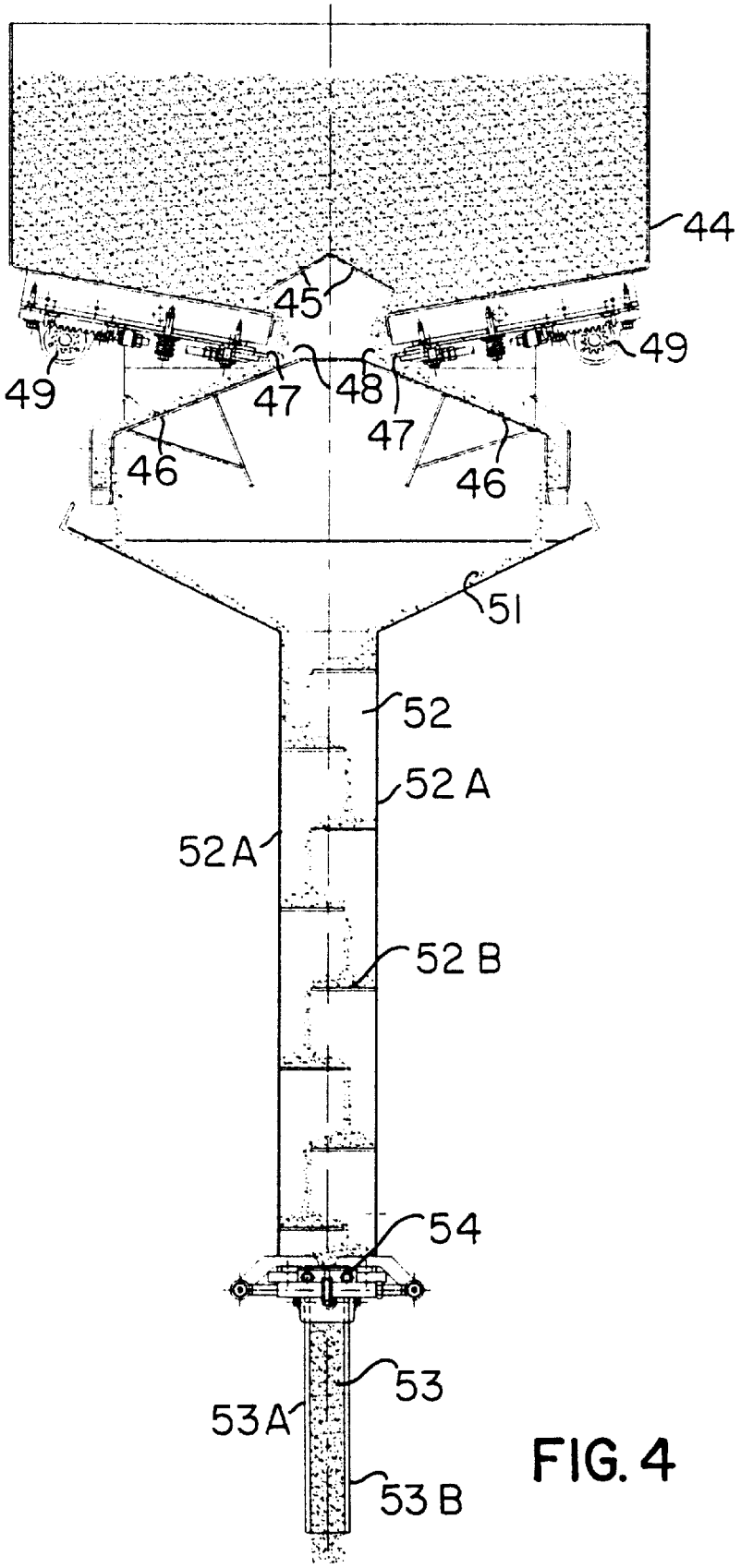
FIG. 4 is an enlarged view of the introducer system for feeding particles to the electrostatic zone of separation as shown in FIG. 3.

The introducer system described above may be seen in FIG. 4, and also in portions of the assembly drawings, FIGS. 1–3.

Feed supply bin 44 contains the bulk of the particles to be fed to the separator. The bottom of bin 44 is sloped toward the center where an exit baffle 45 directs the supply of feed to the vibrating tray 46. The opening to vibrating tray 46 is controllable by extending or retracting a blade 47 toward or away from the top surface 48 of vibrating tray 46. The setting of blade 47 may be moved by a rack and pinion gear mechanism 49 or any other suitable adjusting means. Feed moves outward by vibration and gravity to the outer portions of surface 48 and then falls onto sloping trough 51 which collects the feed and drops it into a vertical space 52 between two parallel plates 52A. That space 52 is interrupted by a series of parallel horizontal baffles 52B intended to reduce the speed of falling particles to a very low figure. The bottom of space 52 communicates with the top of a feed discharge space 52 formed by two parallel plates 53A arranged to make space 53 similar to space 52, but narrower. The transition between space 52 and space 53 is adjustable by a turnbuckle mechanism 54 to allow the width of space 53 to be adjusted to suit specific volumetric through-puts. The discharge from space 52 falls freely as a curtain of particles between two identical banks of electrodes 10 and brushes 11 wherein. The particles are separated according to their electrostatic charges.

Two splitters 20 are shown in FIG. 3. These splitters 20 are separately adjustable along a horizontal scale 55 so as to define a central zone between splitters 20 so as to collect those particles that have not been deflected outwardly of splitters 20. That central fraction is collected in central area 21 and removed through central exit 35. The particles that are deflected outwardly beyond splitters 20 to the right and to the left thereof are collected in outer areas 22 and removed through exits 37.

The third improvement described herein is termed the "air wipe" system, and is employed to provide longer periods of operation with less frequent shutdowns for maintenance operations. Principally this system relates to providing longer life to bearings which support the electrodes 10 and the brushes 11. These bearings must be maintained clean of dust or the bearings will become inoperative. Accordingly the "air wipe" system is important in allowing for longer production periods with less shutdowns for maintenance.

The general principle involved in this air wipe system is to introduce low pressure air internally to the bearings and permit that low pressure air to be expelled outwardly around the bearing shaft and the neighboring apparatus. An air channel is affixed to the central nonrotating tube of the electrode structure of three concentric tubes. This channel has an upper inlet leading to a supply at low pressure air and outlets above and below the bearing supporting the electrode. The outlets are directed outwardly toward the outer tube of the electrode structure and thus may escape to the outside of the outer tube through interstices in the electrode structure to blow away any dust that might settle there. The inlet to the air channel is connected to a source of low pressure air by way of a flexible tube which absorbs any vibration that might otherwise make the distribution of the low pressure air difficult because of the rotation of the electrodes.

Figure 7:
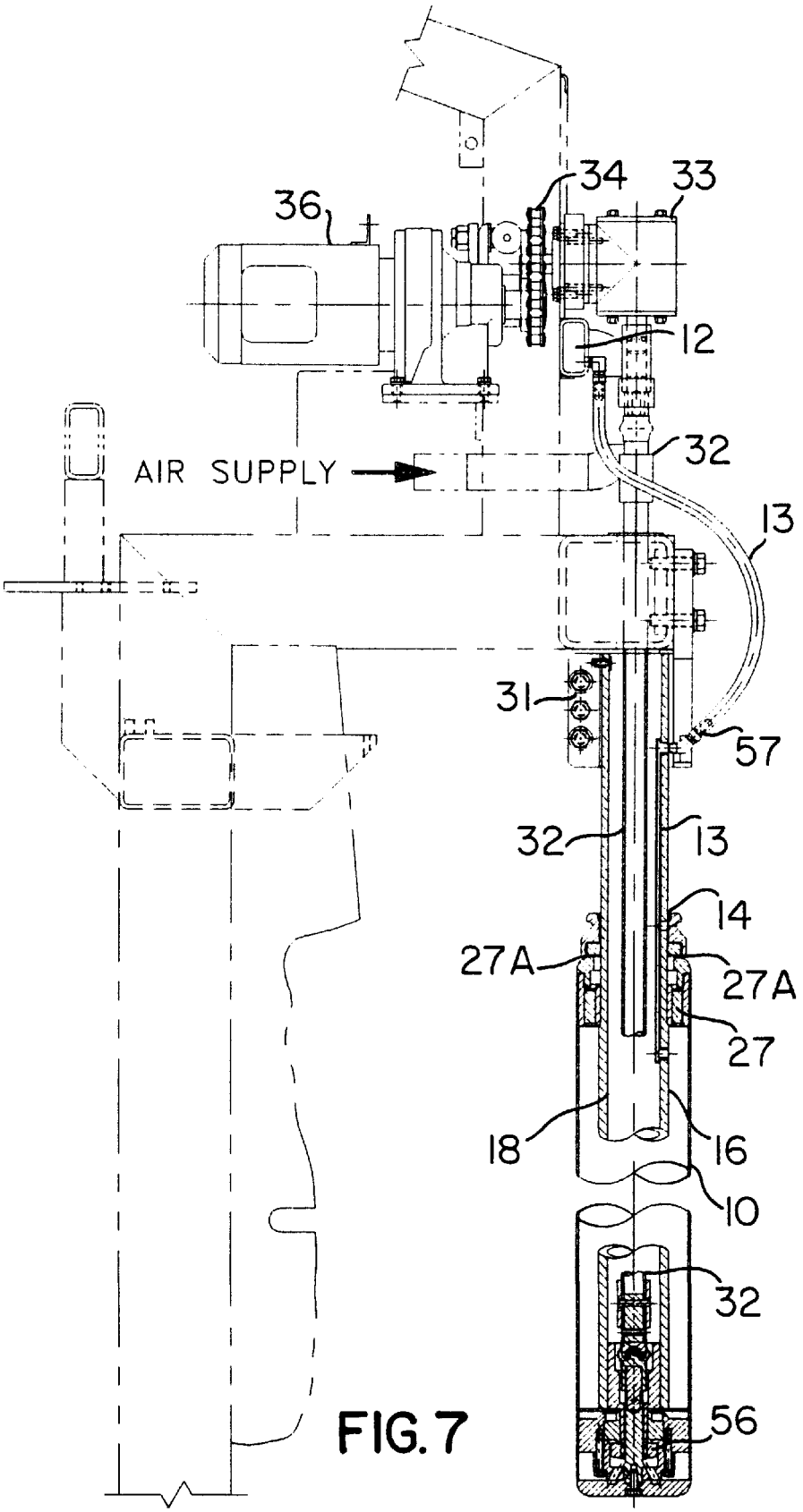
FIG. 7 shows an enlarged view of the air wipe system which prevents dust from accumulating around the bearings supporting the electrodes.

The details of the improvement relating to the "air wipe" system may be best understood by reference to FIG. 7, along with FIGS. 1–3. Air at low pressure (2–5 psi) is supplied to a duct 12 positioned along the upper ends of the shafts 32 driving electrodes 10. From duct 12, adjacent each electrode 10, is a short length of flexible tubing 13, which connects duct 12 to inlet 57 at the upper end of air channel. Outlets 14 and 16 direct the air outwardly of tube 18 above and below bearing 27 which supports electrode 10 and allows it to rotate. The air from outlets 14 and 16 exhausts through interstices in the structure around bearing 27, as illustrated by arrows 27A, and thus prevents accumulations of dust from occurring and thereby causing equipment shutdowns.

Figure 5B:
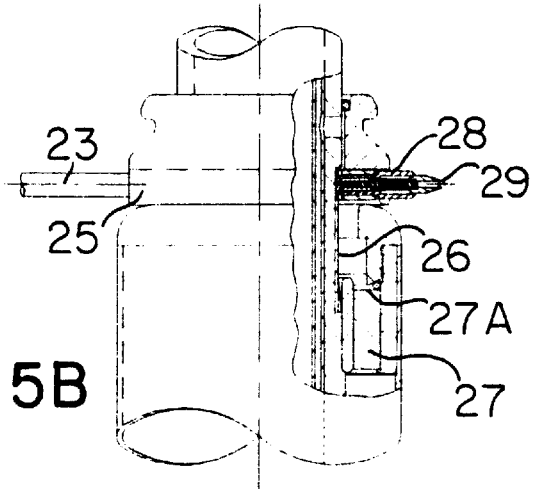
FIGS. 5A and 5B are enlarged views of a portion of FIG. 1 showing the electrical connections between electrodes which maintains the electric charge that produces the separation between different types of particles fed to the separator system of this invention.
Figure 5A:
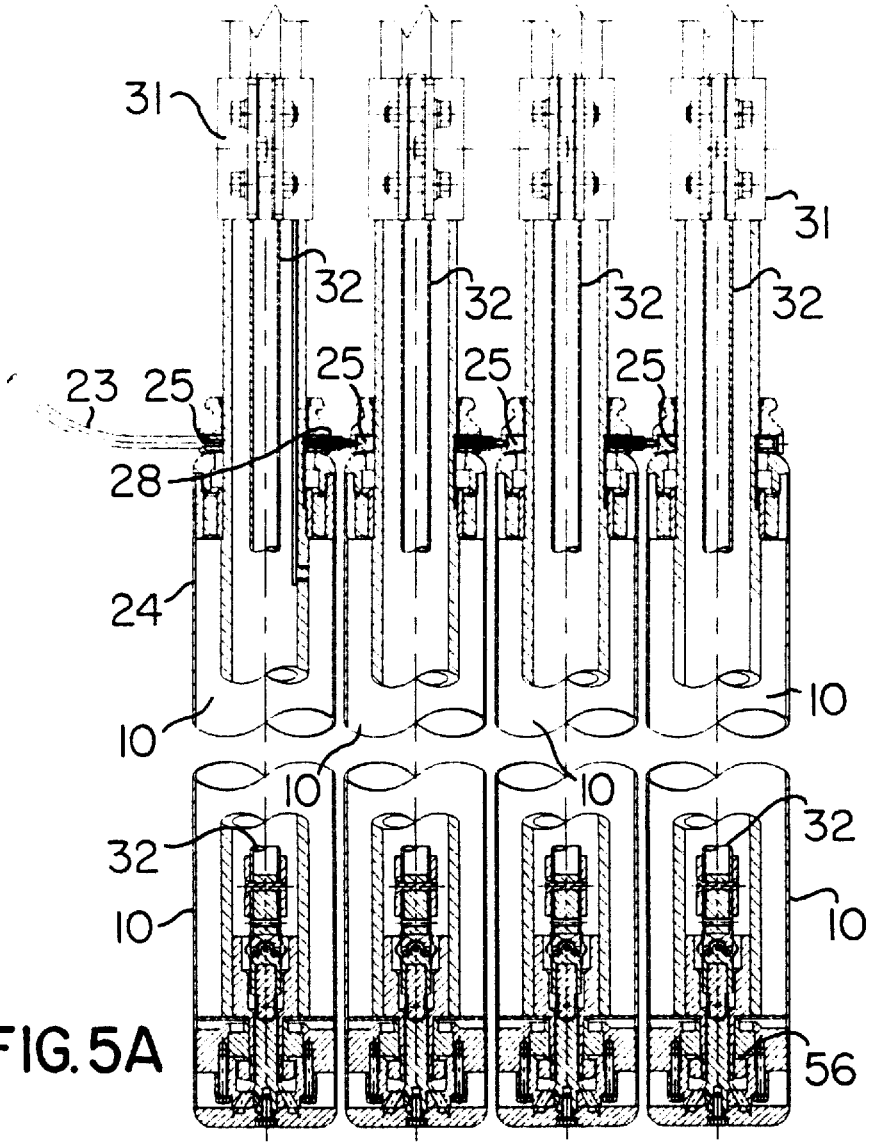

The fourth improvement relating to the commutation system is shown generally in FIGS. 1–3 and specifically in FIG. 5. In order for the separation system of this invention to function properly, the electrodes 10 must be charged with a high voltage with the electrodes 10A on one side of the falling particles positively charged and the electrodes 10B on the other side of the falling particles negatively charged. Because of the novel arrangement of suspending the electrodes 10 from one end only of the electrode it was considered best to provide the electrical charging from the suspended end only of the electrode, and thereafter to have the charging voltage conducted from one electrode to the next while the electrodes are rotating.

A commutation system has been provided whereby a high voltage charge from a generator is conducted by a lead wire 23 (FIGS. 1 and 5) to the first electrode 24 by way of a commutator ring 25, a commutator strip 26, bearing inner race 27A and bearing 27. Voltage from input wire 23 is conducted through clamp ring 25, commutator strip 26, bearing inner race 27A to bearing 27 and thence to electrode 10. At the same time voltage reaching commutator port assembly 28 is commutated to the next electrode through the spring mounted tip 29 which presses against the clamping ring 25 of the next adjacent electrode 10. In this manner the necessary charging voltage is conducted from one source, e.g., a generator, to an entire bank of electrodes from one to the next.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed is:

1. In an apparatus for electrostatically separating a feed mixture of two types of particles which includes feeding the particles into the upper feed end of vertical free fall zone having an upper feed end and a lower discharge end between two horizontally spaced rows of a plurality of spaced elongated cylindrical electrode assemblies rotating about respective vertical axis, said lower discharge end having a splitter coextensive with said discharge end and recovering two separated products each of different types of particles originally in said feed mixture said rotating electrode assemblies being continuously cleaned by a plurality of vertically positioned, rotating, elongated cylindrical brushes contacting said electrodes in each of said two rows, means for rotating said electrodes and said brushes, and means for applying an electric charge to each of said electrodes in each of said two rows, the improvement wherein each said rotating vertical electrode having an upper end rotationally and structurally supported in a bearing in said apparatus and a freely hanging lower end spacedly above said splitter.

2. The apparatus of claim 1 wherein each said rotating electrode including three concentric tubes, the outer and inner of which being affixed to each other and concurrently rotating during operation of said apparatus, and the central of said three tubes being nonrotational.

3. The apparatus of claim 2 wherein said central nonrotational tube includes a wall having a lengthwise conduit extending from an inlet port above said bearing to an exit port below said bearing, said inlet port communicating with a source of air under a positive pressure to deliver air through said bearing outwardly of said electrode.

4. The apparatus of claim 3 wherein said conduit includes at least another exit port, said another port being located in upper portion of said bearing.

5. The apparatus of claim 1 wherein said vertical free fall zone includes a feed chute of two parallel vertical walls extending from an upper feed hopper to a lower discharge end positioned midway between said upper ends of said two rows of electrodes; said chute including longitudinally spaced transverse baffle plates alternately extending from opposite walls to an open edge in the central space between said walls.

6. The apparatus of claim 1 further comprising an air supply, said electrodes including passageways for directing air from said supply to be emitted through said bearings from inside said electrodes outwardly to inhibit dust particles from entering said bearings.

7. The apparatus of claim 1 wherein each said electrode and brush includes at least one passageway for directing air to be emitted through said bearing to inhibit dust particles from entering said bearing.

8. The apparatus of claim 1 wherein said electrodes are connected to each other electrically by commutator rings, commutator strips, and commutator bearings for transmitting said electric charge between said electrodes to produce zones for separating said particles being fed into the apparatus.

9. The apparatus of claim 6 further including air passageways having an outlet directing low pressure air from interior to exterior of one said electrode adjacent said bearing supporting said electrode to inhibit dust particles from entering said bearing.

10. The apparatus of claim 1 wherein one said electrode is connected to another adjacent electrode electrically by a commutator ring, a commutator strip, and said bearing said electric charge on said one electrode activating said another adjacent electrode.

11. The apparatus of claim 1 wherein said means for applying an electrical charge includes an electrical connection between adjacent said electrodes, a spring-loaded needle-head assembly attached to a stationary support at one said electrode with its spring-loaded needle-head bearing against a brass strip which electrically contacts a bearing supporting an adjacent said electrode.

12. The apparatus of claim 1 wherein one said electrode includes a spring-loaded needle-head assembly attached to a stationary support of said one electrode, another adjacent said electrode carrying a brass strip, said spring-loaded needle-head contact being in contact against said brass strip, said brass strip being in electrical contact with said bearing supporting said another electrode.

13. The apparatus of claim 1 wherein said bearing is electrically conducting, said bearing having a nonrotational base electrically connected via a metal strip to a base of a spring-loaded, needle-headed electrically conducting contact which bears against a commutator ring in an adjacent said electrode assembly.

14. The apparatus of claim 1 further including an air passageway having an outlet directing low pressure air from interior to exterior of each said electrode and each said brush adjacent said bearing supporting respective said electrode and said brush to inhibit dust particles from entering said bearing.

15. The apparatus of claim 1 wherein said bearing is electrically conducting, said bearing having a nonrotational base electrically connected via a metal strip to a base of a spring-loaded, electrically conducting contact which bears against a commutator ring in an adjacent said electrode assembly.

16. In an apparatus for electrostatically separating a feed mixture of two types of particles which includes feeding the particles into the upper feed end of vertical free fall zone having an upper feed end and a lower discharge end between two horizontally spaced rows of a plurality of spaced elongated cylindrical electrode assemblies rotating about respective vertical axis, said lower discharge end and recovering two separated products each of different types of particles originally in said feed mixture, the improvement comprising said rotating electrodes assemblies being continuously cleaned by a plurality of spaced elongated rotating cylindrical brushes contacting said electrodes in each of said two rows, power means for rotating said electrodes and said brushes, and an electrical means for applying an electric charge to each of said electrodes in each of said two rows, said electrodes and said brushes contacting said electrodes rotating in opposite directions with respect to each other, a bearing for each said electrode and said brush for attaching each said electrode and said brush to said apparatus, each said electrode and said brush having an upper end rotationally and structurally supported in respective said bearing and a lower end hanging free within said apparatus.

17. The apparatus of claim 16 wherein each said electrode and brush including an outer, inner and central concentric tubes, said outer and inner tubes being affixed to each other and rotating together during operation of said apparatus, and said central tube being nonrotational.

18. The apparatus of claim 17 wherein said central nonrotational tube of respective said electrode and said brush includes a wall having lengthwise conduit extending from an inlet port above said bearing to an exit port below said bearing, said inlet port communicating with a source of air under a positive pressure to deliver air through said bearing.

19. The apparatus of claim 18 wherein said conduit includes at least another exit port, said another port being located in an upper portion of said bearing.

20. The apparatus of claim 16 wherein said vertical free fall zone includes a feed chute of two parallel vertical walls extending in space between said walls from an upper feed hopper to a lower discharge end positioned midway between said upper ends of said two rows of electrodes, said chute including longitudinally spaced transverse baffle plates alternately extending from opposite walls to an open edge adjacent said space between said walls.

* * * * *